United States Patent [19]

Muroi

[11] Patent Number: 4,697,811

[45] Date of Patent: Oct. 6, 1987

[54] RACKET AND WEIGHT ATTACHMENT

[75] Inventor: Kunimasa Muroi, Hamamatsu, Japan

[73] Assignee: Nippon Gakki Seizo Kabushiki Kaisha, Hamamatsu, Japan

[21] Appl. No.: 747,022

[22] Filed: Jun. 20, 1985

[30] Foreign Application Priority Data

Jun. 29, 1984 [JP] Japan ..... 59-134514
Jan. 11, 1985 [JP] Japan ..... 60-001957

[51] Int. Cl.[4] ..... A63B 49/04
[52] U.S. Cl. ..... 273/73 C; 273/73 D
[58] Field of Search ..... 273/73 R, 73 C, 73 D, 273/73 H, 73 E

[56] References Cited

U.S. PATENT DOCUMENTS

| | | | |
|---|---|---|---|
| 3,930,648 | 1/1976 | Brown | 273/73 D |
| 4,042,238 | 8/1977 | Theriault | 273/73 C |
| 4,204,681 | 5/1980 | Hall, Jr. et al. | 273/73 C |
| 4,314,699 | 2/1982 | Bayer et al. | 273/73 D |

*Primary Examiner*—Anton O. Oechsle
*Assistant Examiner*—Matthew L. Schneider
*Attorney, Agent, or Firm*—Sachs & Sachs

[57] ABSTRACT

A racket for tennis or like games utilizing one or more weight straps, preferably flexible, that are detachably fastened to the frame head by strings in tension for easy weight and balance adjustment by users in accordance with subtle difference in personal preference and to provide a safe weighting device which is unlikely to detach and cause accidental injury during use of the racket. The weight straps consist of a plurality of unit sections that are separated by spaced notches. The spaced notches permit a portion of the weight strap to be severed from the rest of the weight strap so as to allow variable weighting of the racket. The unit sections of the weight straps have holes located therethrough that are aligned with the string holes in a racket. Thus, the weight straps are held in place on the racket through the strings which pass over the weight straps. Additionally, the weight straps include a longitudinal groove for seating the strings and can also include an elastic plate that extends transverse to the longitudinal groove for seating the string.

9 Claims, 8 Drawing Figures

RACKET AND WEIGHT ATTACHMENT

BACKGROUND OF THE INVENTION

The present invention relates to an improved racket for tennis and like games, and more particularly relates to an improvement in weight adjusting mechanism of a racket frames used for games such as tennis.

Although the following description is directed mainly to a tennis racket for simpler understanding, the present invention is well applicable to like rackets used for other like games such as squash.

In general, weights of tennis rackets are classified into three different grades in accordance with the level of play technique by users, i.e. beginners grade, middle grade and experts grade.

Conventionally such weight adjustment is carried out at production by, for example, embedding a weight adjuster piece or pieces into the head and/or the grip of a tennis racket, or bonding such a piece or pieces to these sections of a tennis racket. Weight adjustment is carried out by design of a racket frame also. In either case, weight adjustment is fixed at the stage of production by producers and no further subtle weight adjustment can be done by users in accordance with personal preference. Further, in particular when such weight adjuster pieces are bonded to a tennis racket, they tend to fall during use of the tennis racket due to impulse at striking balls thereby endangering the users.

SUMMARY OF THE INVENTION

It is the basic object of the present invention to provide a racket for tennis and like games which enables users to easily carry out subtle weight adjustment in accordance with personal preference.

It is another object of the present invention to provide a racket with utmost safety in use.

In accordance with the basic concept of the present invention, a racket comprises a substantially oval frame head with string holes and at least one weight strap fastened, at a selected section, to the outer face of the frame head by corresponding strings in tension, the weight strap includes at least two unit sections separated by a transverse notch, each unit section includes a pair of aligned through holes spaced apart from each other by a distance equal to a corresponding string hole pitch, and at least one of the unit sections includes a longitudinal groove formed in its outer face extending between the two through holes for reception of the turn-over of a corresponding string.

DESCRIPTION OF THE PREFERRED EMBODIMENTS

Figure 1:
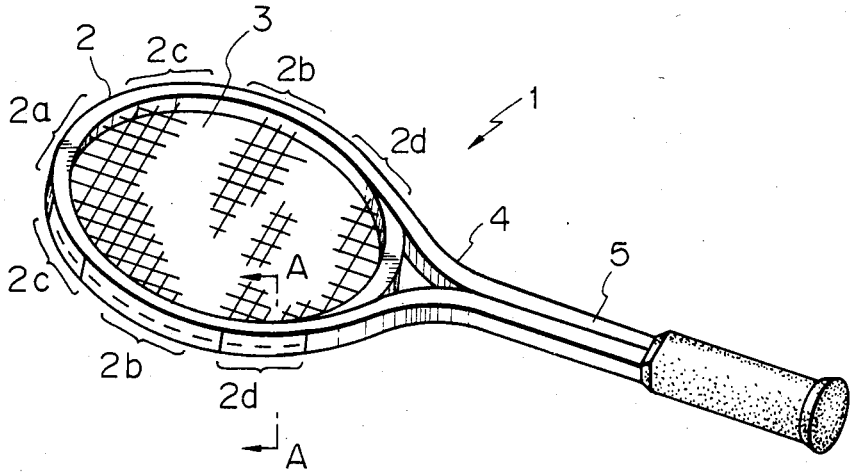
FIG. 1 is a perspective view of one example of a racket to which the present invention is well applicable.

As shown in FIG. 1, a tennis racket 1 is in general made up of a frame head 2, strings 3 stretched in tension, a yoke 4 and a handle 5. As described already, the present invention is characterized by use of a weight strap or straps attached to the outer face or periphery of the frame head 2. That is, the weight strap or straps are attached to the positions 2*a* to 2*d* (except 2*b*) on the outer face of the frame head 2.

Figure 2:
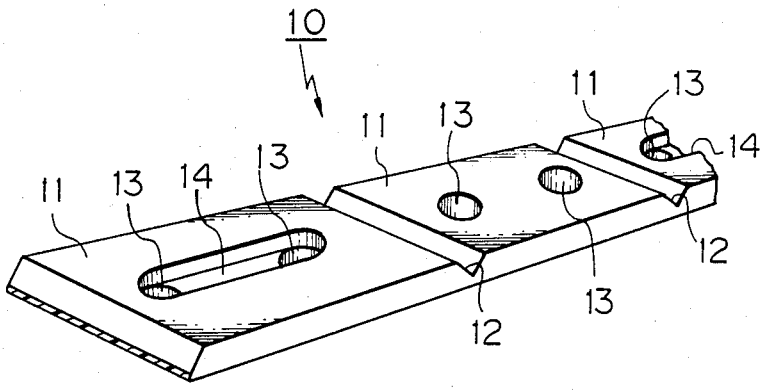
FIG. 2 is a perspective view of a weight strap used for the first embodiment of the present invention.

The first example of such a weight strap is shown in FIG. 2, in which the weight strap 10 is made up of a plurality of unit sections 11 connected to each other but bordered by transverse notches 12. Each unit section 11 has a pair of aligned through holes 13 spaced apart from each other by a distance equal to a corresponding string hole pitch i.e., the distance between adjacent string holes.

The unit section 11 is further provided in its outer surface with a longitudinal groove 14 which between the two through holes 13. As shown in the drawing, the longitudinal grooves 14 are preferably formed in alternate unit sections 11 for increase of the total weight. As later explained in more detail, the longitudinal groove 14 receives therein the turn-over of a string fastening the unit section 11 to the outer face of the frame head 2. The depth of the longitudinal groove 14 should preferably be larger than the diameter of the string for safer protection of the turn-over of the string.

The weight strap 10 is preferably made of a flexible material such as thermoplastic synthetic resin. The length of the weight strap 10 should preferably be from 10 to 12 times as large as the string hole pitch and its thickness should preferably be close to the size of the frame head 2 normal to the face of the racket. The notches 12 enable easy cutting of the weight strap 10 into free lengths by users. They also allow the weight strap to well follow the curvature of the outer face of the frame head 2 in particular when the weight strap is made of a less flexible material.

Figure 3:
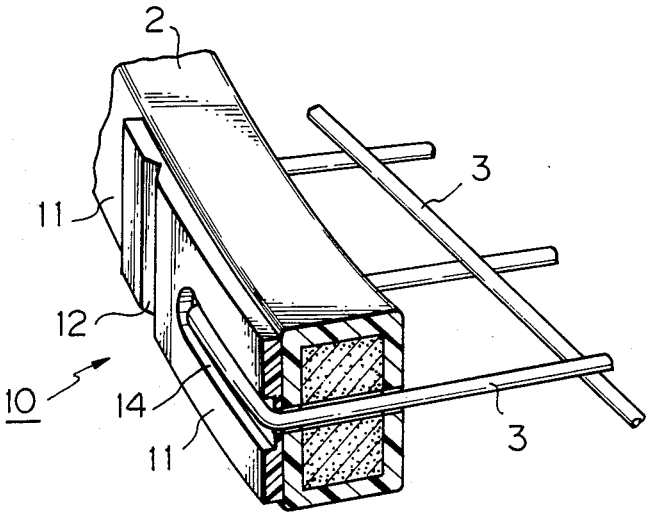
FIG. 3 is an elevated, fragmentary, perspective view of the first embodiment of the present invention with the section taken along a line A—A in FIG. 1.

At weight adjustment, a long band of weight strap is first cut at the notches 12 into a weight strap 10 of a proper length. For precise choice of length, the weight strap 10 so cut is provisionally bonded to a selected position on the outer face of the frame head and the user swings the racket in practice. The length of the weight strap 10 is changed by cutting at the notch 12 untill the user reachs the best feeling in swing. After fixing the best length, strings 3 are set in the frame head 2 as shown in FIG. 3, in which the turn-over of a string 3 stably fasten the weight strap 10 to the outer face of the frame head 2 through the through holes 13 and the turn-over of the string 3 is almost fully received in the longitudinal groove 14.

Although the notches 12 are formed in the outer surface of the weight strap 10 in the above-described example, they may be formed in the inner surface, i.e. the surface to contact the outer face of the frame head 2.

As is clear from the foregoing, subtle weight adjustment of a racket can be carried out very freely and easily by users according to their personal preference by use of the weight straps of the present invention. In addition, since the weight straps are strongly fastened to the outer face of the racket head by means of the strings in tension, dangerous accidental fall of them can be fully avoided.

Figure 4:
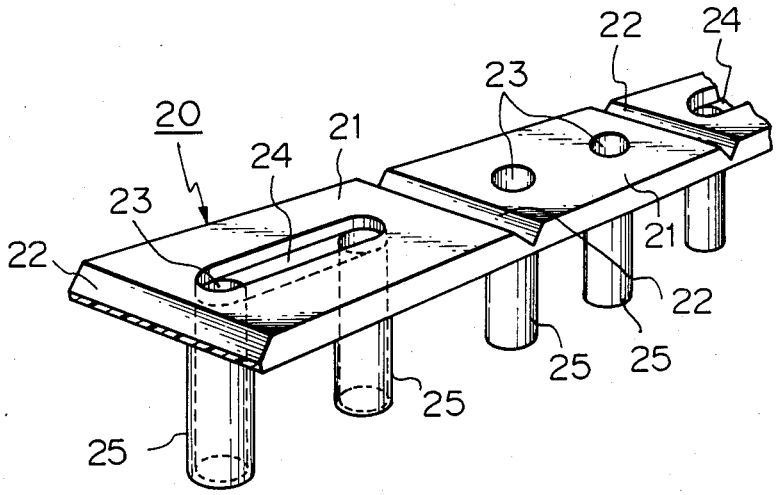
FIG. 4 is a perspective view of a weight strap used for the second embodiment of the present invention.

The second example of a weight strap is shown in FIG. 4, in which the weight strap 20 includes, as the first example, unit sections 21, transverse notches 22, paired through holes 23 and alternate longitudinal grooves 24. Further, each through hole 23 is accompanied with a tube 25 projecting, preferably, in one body, from the inner surface of the weight strap in such a way that the bore of the tube 25 mates with the associated through hole 23. The outer diameter of the tube 25 is somewhat smaller than the string holes in the frame head 2 and the length is somewhat larger than the size of the frame head 2 parallel to the face of the racket.

Figure 5:
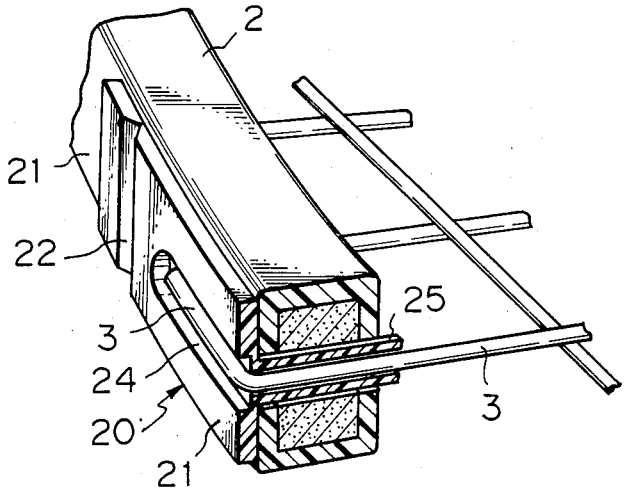
FIG. 5 is an elevated, fragmentary, perspective view of the second embodiment of the present invention with the section taken along the line A—A in FIG. 1.

As in the first embodiment, personal weight adjustment is initiated by choice of a proper length of the weight strap 20 and, at mounting, the tubes 25 are inserted into string holes in the frame head 2 as shown in FIG. 5. Presence of the tubes 25 engaging the string holes and covering the strings 3 assures stabler mounting of the weight straps 20 and good protection on the strings 3.

Figure 6:
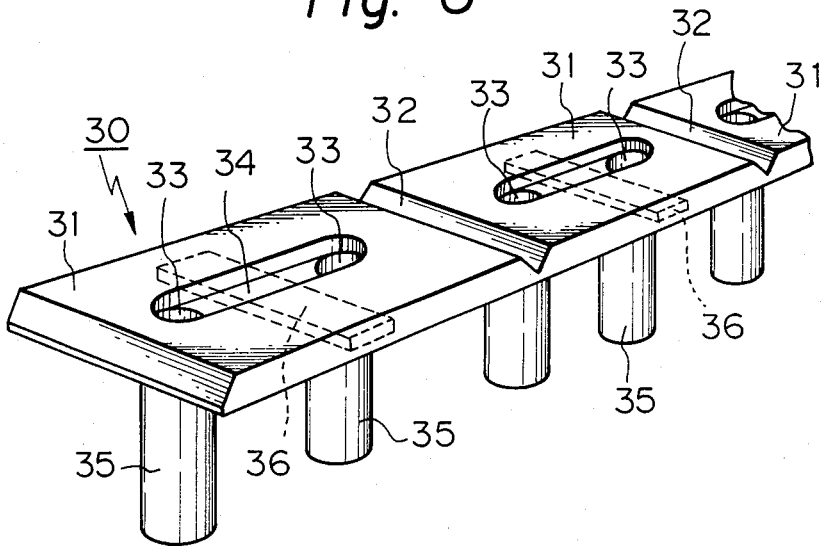
FIG. 6 is a perspective view of a weight strap used for the third embodiment of the present invention.

The third example of the weight strap is shown in FIG. 6, in which the weight strap 30 includes, as the second example, unit sections 31, transverse notches 32, paired through holes 33, longitudinal grooves 34 and tubes 35. Further, each unit section 31 is provided with an elastic plate 36 such as a leaf spring which is elastically embedded in the inner face of the weight strap 30 and extends in a direction across the direction of the longitudinal groove 34. The elastic plate 36 extends over a groove 6 formed on the outer face of the frame head 2.

Figure 7:
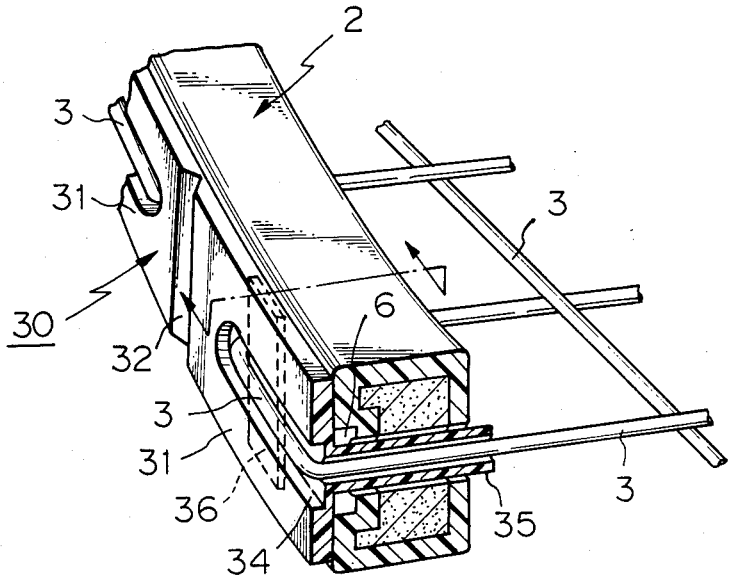
FIG. 7 is an elevated, fragmentary, perspective view of the present invention with the section taken along the line A—A in FIG. 1.
Figure 8:
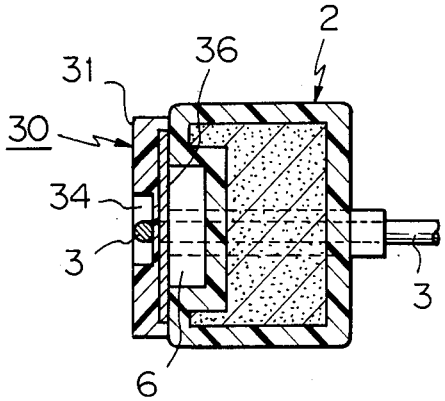
FIG. 8 is a transverse cross sectional view of the third embodiment of the present invention shown in FIG. 7.

As in the first and second embodiments, personal weight adjustment is initiated by choice of a proper length of the weight strap 30 and, at mounting, the tubes 35 are inserted into string holes in the frame head 2 as shown in FIGS. 7 and 8. Spring support of the turn-over of the strings by the elastic plates 36 generates increased stretch on the strings and well enlarges the area of the sweet spot of the face of the racket.

I claim:

1. A racket for tennis and like games comprising a substantially oval frame head with string holes for strings, said oval frame head having an outer periphery, and at least one weight strap having an inner and an outer surface, said weight strap being fastened, at a selected position, to the outer periphery of said frame head by the turn-over of a corresponding string in tension, said inner surface of said weight strap being proximate to said outer periphery of said frame head, said weight strap including at least two unit sections separated by a transverse notch, each said unit section including a pair of aligned through holes spaced apart from each other by a distance equal to a corresponding distance between adjacent said string holes, the thickness of said weight strap at the location of said notch being less than the thickness of said strap at locations other than the notch so as to facilitate separation of said weight strap into two unattached sections, the thickness being measured in a direction parallel to the axes of said through holes, said transverse notch being located at a position other than the position of a through hole, and at least one of said two unit sections including a longitudinal groove which is formed in said outer surface thereof whilst extending between said through holes for reception of said turn-over of said corresponding string.

2. A racket as claimed in claim 1 in which each said through hole in said weight strap includes a tube projecting from said inner surface of said weight strap in communication with said through hole.

3. A racket for tennis and like games comprising a substantially oval frame head with string holes for strings, said oval frame head having an outer periphery, at least one weight strap having an inner and an outer surface, said weight strap being fastened, at a selected position, to the outer periphery of said frame head by the turn-over of a corresponding string in tension, said inner surface of said weight strap being proximate to said outer periphery of said frame head, said weight strap including at least two unit sections separated by a transverse notch, each said unit section including a pair of aligned through holes spaced apart from each other by a distance equal to a corresponding distance between adjacent said string holes, at least one of said two unit sections including a longitudinal groove which is formed in said outer surface thereof whilst extending between said through holes for reception of said turn-over of said corresponding string, and an elastic plate elastically placed in the inner face portion of each said unit section of said weight strap and extending in a direction across the direction of said longitudinal groove.

4. A racket as claimed in claim 1, 2 or 3 in which said weight strap is made of a flexible material.

5. A racket as claimed in claim 1, 2 or 3 in which said longitudinal grooves are formed in alternate unit sections.

6. A racket as claimed in claim 1, 2 or 3 in which the depth of said longitudinal groove is larger than the diameter of said string.

7. A racket as claimed in claim 1, 2 or 3 in which the length of said weight strap is from 10 to 12 times as large as said said distance between adjacent said string holes.

8. A racket as claimed in claim 1, 2 or 3 in which said substantially oval frame defines a playing face, the width of said weight strap being close to the size of said frame head normal to said playing face of said racket.

9. A racket as claimed in claim 3 in which each said through hole in said weight strap includes a tube projecting from said inner surface of said weight strap in communication with said through hole.

* * * * *